United States Patent [19]

Wang et al.

[11] Patent Number: 4,727,808

[45] Date of Patent: Mar. 1, 1988

[54] NON-PRIMARY EXPLOSIVE DETONATOR

[75] Inventors: Quicheng Wang; Xianquan Li; Guowen Hu; Xiqin Zhang; Tianrui Xu, all of Wuhan, China

[73] Assignees: China Metallurgical Import & Export Corporation, Beijing; China Metallurgical Safety Technology Institute, Wuhan, both of China

[21] Appl. No.: 768,835

[22] Filed: Aug. 23, 1985

[30] Foreign Application Priority Data

Aug. 23, 1984 [SE] Sweden ..... 8404208

[51] Int. Cl.[4] ..... F42B 3/10

[52] U.S. Cl. ..... 102/202.5; 102/202; 102/202.13; 102/202.14; 102/204

[58] Field of Search ..... 102/202.5, 202.7, 202.8, 102/202.9, 202.11, 202.13, 202.14, 202, 204

[56] References Cited

U.S. PATENT DOCUMENTS

| | | | |
|---|---|---|---|
| 1,570,733 | 1/1926 | Eschbach | 102/202.13 |
| 1,928,205 | 9/1933 | Large | 102/202.11 |
| 2,549,533 | 4/1951 | Sevold | 102/202.11 |
| 2,717,204 | 9/1955 | Noddin et al. | 102/202.13 |
| 2,863,392 | 12/1958 | Hill et al. | 102/202.11 |
| 3,212,439 | 10/1965 | Reyne | 102/202.14 |
| 3,509,820 | 5/1970 | Fitch et al. | 181/116 |
| 3,587,466 | 6/1971 | Prior | 102/275.5 |
| 3,661,085 | 5/1972 | Smith et al. | 102/202.9 |
| 3,724,383 | 4/1973 | Gallaghan et al. | 102/275.9 |
| 3,978,791 | 9/1976 | Lemley et al. | 102/202.14 |
| 4,206,705 | 6/1980 | Iqbal et al. | 102/202.8 |
| 4,239,004 | 12/1980 | Day et al. | 102/202.13 |
| 4,429,632 | 2/1984 | Yunan | 102/202.13 |

FOREIGN PATENT DOCUMENTS 1646340 8/1973 Fed. Rep. of Germany .

*Primary Examiner*—Charles T. Jordan

*Attorney, Agent, or Firm*—Burns, Doane, Swecker & Mathis

[57] ABSTRACT

The present invention relates to a non-primary explosive detonator comprising a hollow tube (1) with a closed end having a chamber containing a secondary explosive base charge (8), an opposite open end provided with or for the insertion of an igniting means (9, 15,16), and an intermediate confinement adjacent said chamber and containing an initiating charge (7), a delay composition (6) optionally being present adjacent said initiating charge. The characteristic feature of the detonator is that the confinement contains a secondary explosive initiating charge (7), by which the current drawbacks in connection with primary explosive initiating charges are reduced, and that it is thin-walled and in the end towards said chamber is open or provided with a thin wall or an aperture (5) or a recess thereof, to accelerate the burning of said secondary explosive initiating charge to a shock wave that causes detonation of said secondary explosive base charge, and a hole (4) which permits ignition of said secondary explosive initiating charge via the igniting means (9). By the special design of the confinement the detonator is very versatile as compared to previously known non-primary explosive detonators.

The invention also relates to a separate initiating element having the structure disclosed above for the confinement.

45 Claims, 21 Drawing Figures

NON-PRIMARY EXPLOSIVE DETONATOR

TECHNICAL FIELD

The present invention relates to a detonator for use as an explosive device or for setting off other explosives and more specifically to a detonator of the non-primary explosive type. Furthermore, the detonator according to the present invention is of the type that comprises a hollow tube with a closed end having a chamber containing a secondary explosive base charge, an opposite open end provided with or for the insertion of an igniting means, and an intermediate confinement adjacent said chamber and containing an explosive charge for the initiation of a detonation of the secondary explosive base charge via said igniting means and optionally also via a delay composition. The novel and characteristic features of the detonator according to the invention are based on a special design of the confinement for the initiating charge and on the use of a secondary explosive as said initiating charge, which features impart to the detonator essential advantages as compared to detonators which utilize primary explosives as the initiating charge and also compared to prior non-primary explosive detonators. The invention also relates to a special initiating element for use in a non-primary explosive detonator of the above-mentioned type.

BACKGROUND OF THE INVENTION

Up to now detonators of the above-mentioned type in commercial use are generally represented by pyrotechnic delay detonators which contain a small charge of a primary explosive placed in contact on one side with a pyrotechnic delay charge and on the other with a secondary explosive base charge, to effect the transition from a relatively slow non-violent chemical burning of the delay charge initiated by an igniting means such as an electrical fuse head to a detonation in said base charge.

In this connection it should be noted that for practical purposes a primary explosive is defined as an explosive substance which can develop complete detonation from a flame or a conductive heating within a volume of a few cubic millimeters of the substance, even without any confinement thereof. On the contrary, however, a secondary explosive can be initiated to detonate by a flame or a conductive heating only if present in very much larger quantities or within heavy confinement such as a heavy walled metal container, or by being exposed to mechanical impact between two hard metal surfaces. Examples of primary explosives are mercury fulminate, lead styphnate, lead azide and diazodinitrophenol or mixtures of two or mor eof these and/or other similar substances. Representative examples of secondary explosives are pentaerythritoltetranitrate (PETN), cyclotrimethylenetrinitramine (RDX), cyclotetramethylenetetranitramine (HMZ), trinitrophenylmethylnitramine (Tetryl) and trinitrotoluene (TNT) or mixtures of two or more of these and/or other similar substances.

In a widely use method of producing a pyrotechnic delay detonator according to the prior art the required weight of secondary explosive for the base charge, typically about 600 mg, is first pressed into the bottom part of a outer metal shell having a closed bottom end. The required weight of primary explosive, typically about 300 mg or less, is then loosely filled into the shell on top of the base charge and compacted by pressing into the shell. Said primary explosive also contains a previously compacted pyrotechnic charge which is thus left with its upper end exposed and its lower end in close contact with the compacted primary explosive.

When exposed to an igniting means such as a flame from an electric fusehead, from a NONEL® tube or from a detonating cord, inserted into the open end of the detonator shell, the pyrotechnic charge starts burning at a rate that is typically of the order of 2–10 cm/s. As soon as the burning pyrotechnic charge reaches the primary explosive there is a rapid transition from burning to detonation within said primary explosive. The resulting detonation in turn initiates detonation in the secondary explosive base charge.

Conventional detonators of the above type have several serious disadvantages. These are primarily derived from the extreme sensitivity of the primary explosive to impact, friction or flame initiation. Some of said disadvantages are:

1. The presence of even a small charge of primary explosive makes a conventional detonator hazardous to handle because it is sensitive to mechanical deformation or impact, such as when accidentally bent or impacted at the region of the primary charge.

2. The manufacture of the primary explosive, the handling of the same and the shell filling operations during manufacture of the detonator are risky operations which require extreme care and caution which in turn means costly operations and expensive plants.

3. The drainage of poisonous water containing fulminate, lead or phenol from the process of manufacture of the primary explosive creates serious environmental pollutions if not controlled. Furthermore, as it is not allowed to transport the bulk primary explosive it is necessary for each detonator plant to set up its own primary explosive plant, which increases the number of polluted areas and also requires additional investments for environmental protection.

It is therefore an object of the present invention to eliminate or minimize the above-mentioned risks, pollutions and high investments, which is accomplished by using instead of the primary explosive a secondary explosive as an initiating charge for detonators of the type referred to above.

It is true that more recently non-primary explosive detonators have been disclosed and patented but generally these new detonators have not come to any widespread general use due to certain disadvantages or limitations. Among such disadvantages and limitations are that generally these previously known non-primary explosive detonators are restricted with reference to the use of the igniting means and with reference to the wall thicknesses of the detonator shell and the dimensions of the confinement for the secondary explosive initiating charge and that they are also generally relatively complex as to their structures which influences upon the manufacture as well as the operation thereof.

As prior art related to non-primary explosive detonators or in connection therewith reference is made to the following patent specifications:

U.S. Pat. No. 3,212,439 discloses a blasting cap which contains secondary explosives only. The detonation of the secondary explosive is caused by another secondary explosive that is compressed and arranged in a confined enclosure in a steel tube having specific dimensions. This confined enclosure provides conditions under which an electrical ignitor ignites the secondary explosive.

U.S. Pat. No. 3,978,791 relates to a detonator device containing secondary explosives only. Also in this case a compressed secondary explosive, "donor secondary explosive", is utilized but together with an impactor disc, a portion of which is released and accelerated when said donor secondary explosive is initiated by a bridge wire. The disc strikes an acceptor secondary explosive with sufficient velocity to produce detonation of the acceptor secondary explosive.

U.S. Pat. No. 4,239,004 discloses a detonator device of a structure similar to that of U.S. Pat. No. 3,978,791 but the device also contains a delay mixture charge that imparts to the device a time delay before the donor secondary explosive is initiated.

DE AS No. 1 646 340 discloses a detonator device for the initiation of a non-sensitive explosive, which contains a fuse and a pyrotechnic time delay element and the essential feature of the device is that it comprises a housing filled with a secondary explosive and open at one end. The open end of the housing is facing the delay element of the other part of the device and removably attached thereto.

U.S. Pat. No. 3,724,383 (1973) relates to a new method of initiation of an explosive, viz. the use of a laser pulse that passes through a fiber optic bundle (9) and a focusing bead (4) to impinge upon a charge (11) of a secondary explosive which is set into low order detonation. A second secondary charge (10) is thereby set into low order detonation but as said second charge is loaded in a gradient of increasing density the velocity of the reaction increases very rapidly and a high order explosion is obtained.

U.S. Pat. No. 4,206,705 (1980) relates to an electrical initiator wherein polymeric solid sulfur nitride $(SN)_x$ is utilized as the sole explosive initiating means thanks to its ability to act as an explosive as well as to conduct electrical current.

U.S. Pat. No. 3,661,085 discloses a new electric initiator structure wherein the pyrotechnic or explosive mix contacts only selected portions of the bridge wire, which means a substantially faster response time than that exhibited by conventional initiators. The explosive charges (primary and secondary charges) are those charges which are conventionally employed in such devices.

DISCLOSURE OF THE PRESENT INVENTION

As should be clear from the above-mentioned an object of the present invention is to provide a detonator which eliminates or at least reduces the disadvantages of the primary explosive detonators as well as eliminates or reduces the disadvantages of the previously known nonprimary explosive detonators or at least offers a valuable alternative thereto. More specifically, there is provided by the present invention a simple design of a non-primary explosive detonator which is conducive to the transition of a secondary explosive from burning to detonation, which offers the advantage of being able to use to the fullest extent those parts and technological equipments which have previously been used in conventional detonators while using less expensive shell materials and explosives and avoiding the risks associated with the utilization of primary explosives. This in turn means a versatility of a non-primary explosive detonator which has hitherto not been possible in connection with the previously known and rather restricted non-primary explosive detonators. Thus, for instance the new detonator according to the present invention is not as restricted as the known non-primary explosive detonators as to the choice of igniting means, secondary explosives, shell materials and thicknesses, etc. Still another object of the present invention is to provide a detonator by which the time of the transition from ignition to detonation is shortened so as to ensure the delay accuracy of high precise detonators. These and additional objects of the detonator as well as the specific initiating element according to the invention will be readily understood by a person skilled in the art from the following more detailed description of the invention.

The characteristic feature of the non-primary explosive detonator according to the present invention is that the confinement is thin-walled and contains a secondary explosive initiating charge, that the end of the confinement towards said chamber is open or provided with a thin wall or an aperture or a recess for an aperture to accelerate the burning of the secondary explosive initiating charge to a shock wave that causes detonation of the secondary explosive base charge, and an access, preferably at the opposite end thereof, which permits ignition of said secondary explosive initiating charge via the igniting means, said access preferably being in the form of a hole allowing escape of reaction product gases formed at the burning of the secondary explosive initiating charge.

Thus, by the new design of the confinement containing the secondary explosive initiating charge it has unexpectedly turned out to be possible to utilize such a great area of burning secondary explosive within the initiating charge that the burning rate is increased to such a level as to create a strong shock wave leading to detonation of the base charge. This is even more unexpected as the confinement can contain a hole that permits escape of reaction product gases formed at the burning of the initiating charge, i.e. said hole means that energy is lost through the escape of said gases. The access can be a means allowing ignition of the secondary explosive of the initiating charge, e.g. an electric resistance wire, with or without a surrounding fusehead, buried within the confinement with electrical connectors sealingly penetrating the confinement wall. However, an access in the form of a hole simplifies ignition and also involves the benefit of being able to utilize any igniting means available within the detonator art. As was mentioned above this represents a major advantage as compared to currently known non-primary explosive detonators. That is, the structure of the confinement according to the present invention makes it possible to make the hole for the igniting means as large as is necessary for the insertion thereof, in spite of the energy losses through said hole. Although ignition means such as a fusehead can be positioned immediately at, in or below the hole, it is suitable to provide an empty space somewhere above the hole to buffer pressure build-up or allow escape of some of the reaction gases from the initiation charge. The space can be positioned for example somewhere between the hole and the ignition means such as immediately above the hole or above a delay element adjacent the hole.

From the above-mentioned it can be gathered that the detonator according to the present invention is adpated for use of any known secondary explosive as the initiating charge which also means that the initiating charge may even be of the same secondary explosive as the base charge, if desired. Representative examples of secondary explosives to be used as the initiating charge, and as the base charge, are the above-mentioned secondary explosives PETN, RDX, HMX Tetryl and TNT but the invention is not in any limited to these explosives only. To modify the reaction rate of the initiating charge it may also be desirable to add to these secondary explosives pyrotechnical materials, e.g. aluminium powder or potassium perchlorate, passivators, e.g. shellac, or surface activators, e.g. a stearate.

According to an especially preferable embodiment, however, the secondary explosive for the initiating charge is PETN or RDX or a mixture of these two explosives. Moreover, said secondary explosive for the initiating charge is preferably extra fine as to particle size, i.e. finer than the explosive for the base charge, which e.g. means that the explosive for the initiating charge passes through a 250 mesh sieve (US Sieve Series) ($\approx <0.06$ mm) while the explosive for the base charge passes through a 150 mesh sieve ($\approx <0.1$ mm). The particle size can preferably be below 30 $\mu$m and most preferably below 20 $\mu$m. Other preferable data for the explosive to be used as initiating charge are: specific surface 5000–7000 $cm^2/g$; pressing density 1.2–1.6 $g/cm^3$, preferably 1.3–1.6 $g/cm^3$. Said data can be accomplished in a physical, chemical or mechanical way. As to the base charge it is generally conventional with reference to the above-mentioned properties, but it may also sometimes be suitable to use as said base charge part of the above-mentioned specific composition used for the initiating charge and part of a conventional secondary explosive.

According to an especially preferable embodiment of the invention there is also used, between the initiating charge within the confinement and the base charge, e.g. adjacent the aperture or the thin wall and outside confinement, a secondary explosive that is more loosely pressed than the initiating charge. Compared to the above-mentioned range of 1.2–1.6 $g/cm^3$ this may mean a pressing density within the range of 0.8–1.4 $g/cm^3$, preferably around 1.0 $g/cm^3$. This normally means that this intermediate charge of low density will be surrounded by the initiation and base charges of higher density. Preferably the intermediate charge is better confined than the base charge.

The end of the confinement facing the base charge is critical for the function of the initiating charge. This end can be entirely open for best transmission of the shock wave to the base charge, which is possible if the remaining parts of the confinement are sufficient for transition into detonation of the deflagrating secondary explosive. This end can also be provided with a thin wall to increase confinement, cause shock wave reflections with interferences and simplify manufacture. Since the wall also to some degree prevents shock wave transmission to the base charge, it should not be too thick and is preferably less than 3 mm and most preferably below 1 mm in thickness. The wall can be smooth and uninterrupted. It can also be provided with an aperture, or a weakening for an aperture, to thereby amplify a shock wave and allow also a weakly developed wave to penetrate the wall and cause ignition of the base charge whereby the reliability will be improved. In either design of the wall, it is preferred for reliability reasons that the deflagration to detonation transition takes plase in the confinement at latest at the wall.

With reference to the aperture of the confinement for the initiating charge the main purpose thereof, and its size relative to the size of the initiating charge, is to accelerate the burning of the initiating charge to such extent that the burning gases create a shock wave that causes detonation of the base charge. The cross-sectional area as well as the shape of said aperture cannot be exactly defined in general terms as these parameters are dependent on other factors such as the material and wall thickness of the confinement, types of secondary explosives, amounts and configurations thereof, etc., but now that the inventive idea has been disclosed the necessary or optimum dimensions and shape of the aperture can easily be established by a person skilled in the art by routine experimental work. According to a preferable embodiment of the invention, however, the cross-sectional area of the aperture is substantially less than the average cross-sectional area of the secondary explosive initiating charge, as this means a very rapid and accurate detonation of the base charge. While referring to the above discussion as to the exact dimensions of the aperture a typical ratio between the cross-sectional area of the aperture to that of the secondary explosive initiating charge is from about 1:2.5 to 1:4 although it may sometimes also be preferable to utilize a ratio that is less than 1:5. In the case of circular cross-sectional areas the above-mentioned ratios correspond to the ratios as to diameters of from about 1:1.6 to 1:2 and less than about 1:2.3, respectively.

Furthermore, a complete aperture need not necessarily be present from the beginning as the invention works also if said aperture is created during operation of the detonator. That is, according to another embodiment of the detonator it contains a recess only for the aperture to be formed but still the main function of the detonator is based on the shock wave generated during the burning of the initiating charge which in turn means that the recess leaves typically a thin sheet or similar which is burst by the accelerated gases.

Although it is possible tha the column of secondary explosive, when seen in the detonation direction, has a smaller diameter of about the aperture size after the wall, it is preferred that the diameter increases again after the aperture, preferably to about the same diameter as before the wall. It is also preferred that the wall in which the aperture is formed is short and preferably only of the above mentioned wall thickness so that the aperture forms a short restriction in the explosive column.

The length of the initiation charge up to the wall or the length of the open-ended confinement is suitable sufficient for transition into detonation of the burning secondary explosive. The necessary length is quite short in the present design and can be kept below 50 mm, is suitably between 3 and 25 mm and preferably between 5 and 20 mm. Also the diameter of the charge can be kept small such as below 15 mm and preferably also below 10 mm.

According to another especially preferable embodiment of the detonator according to the invention the confinement containing the secondary explosive initiating charge is an element that is not integral with the shell of the detonator tube but is separate from said tube. This embodiment offers great advantages as compared to the prior art as in this way the initiating charge can be manufactured and handled completely separate from the detonator up to the use thereof.

Apart from the obvious safety aspects thereof this means for instance that the initiating element may even by adapted to be incorporated into a currently available detonator of the primary explosive type, the primary explosive initiating charge being replaced by the new initiating element according to the present invention.

With reference to the hole of the confinement or initiating element the cross-sectional area of said hole can be of about the same size as, but is preferably substantially less than the average cross-sectional area of the secondary explosive initiating charge. However, as said hole generally involves energy losses it should preferably only be large enough to permit ignition of the initiating charge inside the confinement. A typical ratio between the area of the hole and that of the initiating charge is, however, from about 1:1.1 to 1:6.3, which approximately corresponds to a diameter of from 1:1.05 to 1:2.5 in the case of circular cross-sectional areas. Like the aperture directed towards the base charge, the hole is preferably short to facilitate rapid ignition of the large diameter initiating charge column. As said above, entirely different ignition access means than holes can also be employed.

As to the igniting means it has already been mentioned that the detonator according to the invention permits the use of any igniting means available within the detonator area. As examples of such igniting means reference is made especially to an electric fusehead, a low energy cord, a NONEL tube, or other detonating signal transmission lines or a safety fuse but as is said the invention is not limited thereto.

In the case the igniting means does not provide at the exposed surface of the initiating charge a sufficient combination of high enough temperature and pressure with a long enough duration to ensure that the initiating charge starts burning, then a special flame-conducting pyrotechnic composition capable of being ignited by the weak igniting means and also capable of igniting the initiating charge to start burning may be placed in contact with the exposed surface of the initiating charge. Such a flame-conducting pyrotechnic composition may also be placed between a delay element and the exposed surface of the initiating charge if the delay charge composition itself is not able to initiate the initiating charge to start burning.

According to yet another embodiment of the detonator according to the invention, in the case when the confinement is represented by a separate element, said element comprises a shell which may contain said hole and is open at the opposite end thereof, and a separate cap or disk which fits into said open end and contains said wall, aperture or recess. In this way for instance the manufacture of the elements can be facilitated economically by using existing technology and equipment. Preferably the cup or disc is kept fixed against the shell, e.g. by being slightly oversized in relation to the inner diameter of the shell.

Although the exact or desired configuration of the aperture is determined by a person skilled in the art from case to case a preferable cross-sectional area of the aperture or recess may be a circular one. Moreover, it has been found to be especially preferable for the aperture or recess to include a surface of revolution, especially in the form of a hemisphere, a cone or a paraboloid.

Yet another essential feature of the detonator claimed is that it enables the use of a thin-walled confinement or element, such as below 2 mm and even below 1 mm in thickness, as well as the user of a similar thin-walled hollow tube. This results in a large burning area of initiating charge. The special design of the confinement with said wall or aperture results in a reflection of the weak shock wave accompanying the burning which additionally increases the shock pressure. The proviso for these features is that the confinement is of a strong material, for instance of steel. However, the detonator shell can be made of a very cheap material such as paper or plastic. A preferred wall thickness of the steel confinement part, which may contain the hole is within the range of 0.5–1 mm, especially 0.5–0.6 mm. For that part of a steel confinement which contains the wall or aperture or recess therefor a preferred wall thickness is within the range of 0.3–0.25 mm for said aperture part and 0.08–0.15 mm for said recess part, respectively. The wall or aperture part can be designed in a weaker material than steel since it represents a small fraction only of the confinement and since axial confinement is supported by the explosive charges.

From the above disclosure it can also be seen that the detonator can also include a delay substance or composition. As is obvious to a person skilled in the art delay in this connection means time delay and the delay composition can be any of those delay compositions which are utilized in the detonator field, e.g. a mixture of finely ground ferrosilicon or silicon, red lead and burning speed regulators. According to a preferable embodiment of the invention the delay composition is incorporated into the confinement or the separate initiating element which for instance means that a separate initiating element can be manufactured which contains the initiating charge as well as the delay composition for an easy incorporation into a detonator tube. Alternatively a normal delay element, e.g. containing a delay composition column in a thick-walled metal cylinder, can be positioned above the initiating element.

According to another aspect of the invention there is also claimed the above-mentioned separate initiating element and the characterizing features of said element are that it comprises a casing containing a secondary explosive initiating charge and optionally a delay composition, the casing being thin-walled and in the end intended to be positioned towards the base charge being open or provided with a thin wall or an aperture, or a recess for an aperture, for the acceleration of burning of said secondary explosive initiating charge to a shock wave that causes detonation of the secondary explosive base charge, and a hole, preferably at the opposite end thereof, which permits ignition of the secondary explosive initiating charge via the igniting means.

The especially preferable embodiments of the initiating element according to the invention have already been disclosed and discussed above in connection with the detonator and need not be repeated here. Thus, the essential features of said embodiments are those features which are claimed in claims dependent on the initiating element claim.

DRAWINGS

The detonator and the initiating element according to the invention as well as the functioning thereof will now be described more in detail in connection with the drawings, in which:

FIG. 1 is a cross-sectional view of one embodiment of a detonator according to the invention;

FIG. 2 schematically shows the function of the detonator shown in FIG. 1;

Figure 9:
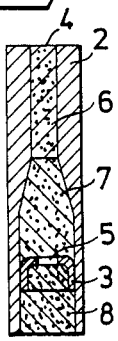
Figure 11A:
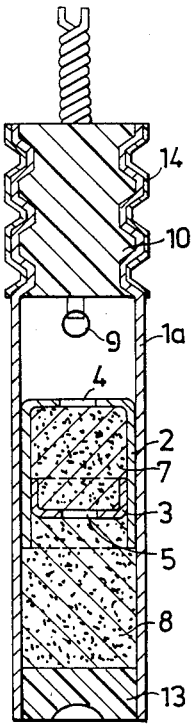
Figure 11B:
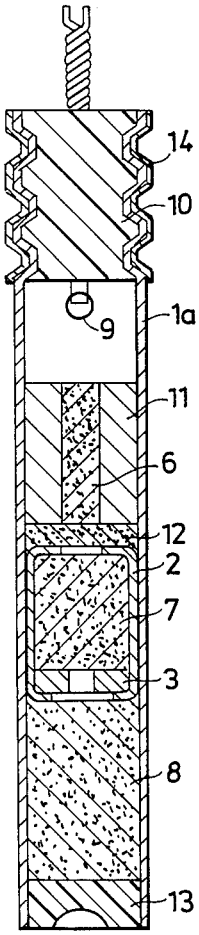
Figure 12A:
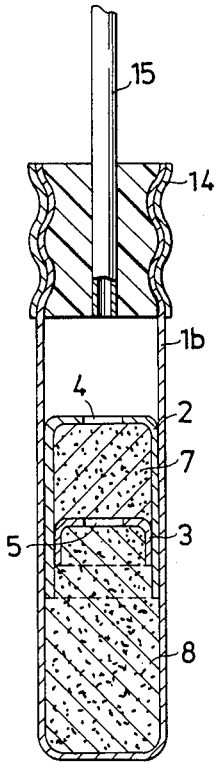
Figure 12B:
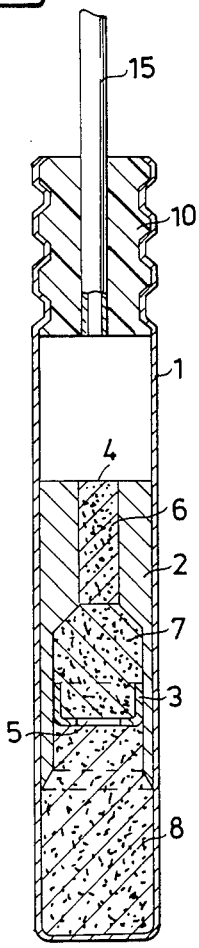
Figure 13:
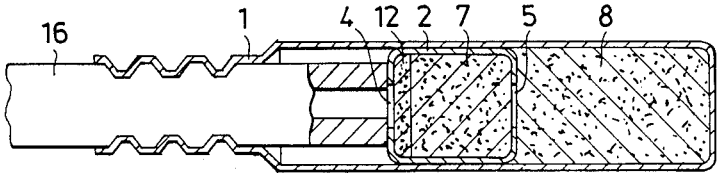

FIGS. 10*a*–10*g* show cross-sectional views of different embodiments of caps or disks of the initiating element according to the invention;

FIG. 11*a* is a cross-sectional view of another embodiment of a detonator according to the invention without any delay composition;

FIG. 11*b* is a cross-sectional view of another embodiment of the detonator according to the invention with a separate delay composition;

FIG. 12*a* is a cross-sectional view of yet another embodiment of the detonator according to the invention without any delay composition;

FIG. 12*b* is a cross-sectional view of another embodiment of the detonator according to the invention with a delay composition and with an initiating element of the type shown in FIG. 9; and FIG. 13 is a cross-sectional view of still another embodiment of the detonator according to the invention.

Firstly, it should be noted that for all drawing Figures, for an easy understanding thereof, similar reference numerals are utilized for similar parts of the detonator and elements, respectively, in spite of the fact that said parts may differ from each other as to configuration, placings, etc. This also means that the presence and functioning of each separate part will not be repeated in connection with each Figure as the necessary information can still be easily gathered by a person skilled in the art. The figures show the preferred embodiment of the initiating element in which the access is a hole and in which the end facing the base charge is equipped with a wall having an aperture, The artisan will understand how these features can be changed in accordance with the alternatives described.

Figure 1:
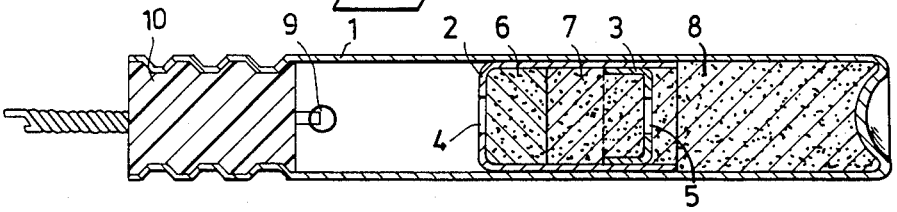

More specifically, FIG. 1 shows a detonator comprising a hollow tube 1 with a closed end and an open end, the closed end containing a chamber with a secondary explosive base charge 8. In this connection, it should be noted that the term chamber is not to be read literally, i.e. the chamber may well be a space only for the base charge, the open end of said space being later restricted by the initiating charge to be described below. At the open end of the tube 1 there is a plastic plug 10 containing an igniting means, in this case an electric fusehead 9. Adjacent to the secondary base charge 8 the tube 1 contains the new initiating element according to the invention which comprises a casing consisting of two parts, viz. an open-ended shell 2 and fitted into its open end a smaller cap 3. Within the casing there is a secondary explosive initiating charge 7 at the end thereof towards the base charge 8 and a delay mixture 6 at the opposite end of the casing. The shell 2 contains a hole 4 intended for ignition via the igniting means 9 and for the escape of gases formed at the burning of the initiating charge 7. The cap 3 contains an aperture 5 towards the base charge 8 for the acceleration of the burning of the initiating charge 7 to a shock wave causing detonation of the base charge 8.

Figure 2:
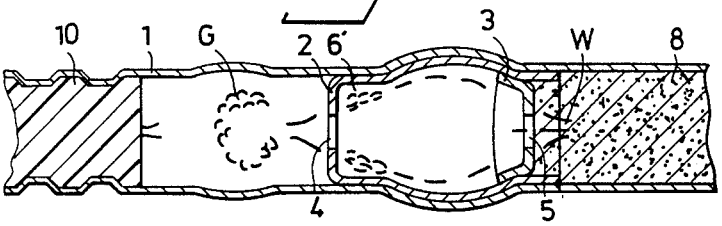

The functioning of the detonator shown in FIG. 1 is schematically shown in FIG. 2. Thus, FIG. 2 shows the transition from the burning of the initiating charge 7 in the initiating element to a shock wave after the ignition of the detonator. When exposed to the flame from the electric fuse head 9 the pyrotechnic charge 6 starts burning at a relatively slow, non-violent rate. When the burning reaches the top of the initiating charge 7, the pressure from the burning sharply increases, some energy losses occurring due to the leakage of gases G from the hole 4 and other energy losses also taking place as a result of the plastic deformation of the shell 2. On one hand, however, the energy losses are compensated for by the accelerated burning of the initiating charge 7, and on the other hand the gases formed are still confined by the deformed shell 2, which in turn means that the pressure in the burning region still continues to rise so as to violently accelerate the burning to the formation of a weak shock wave. This weak shock wave becomes very intense after having reached the aperture 5 in the cap 3 wherein reflection of the shock wave takes place. The gases passing through the aperture 5 also get accelerated owing to the contracted section of the aperture 5, the pulse output from the aperture 5 therefore producing a strong shock wave W in the top part of the base charge 8 which causes the required detonation of the base charge.

From the above-mentioned it is understood that one of the preferred features of the invention is that the forced acceleration of the burning is allowed to take place in a non-closed confinement allowing escape of some reaction product gases and possibly deformation of the casing wall. This in turn for instance means that a relatively thinwalled casing can be utilized allowing a relatively large cross-sectional burning area of the initiating charge.

Figure 3:
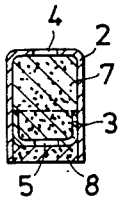
FIGS. 3–6 are cross-sectional views of different embodiments of the initiating element according to the invention without any delay compositions.

In FIGS. 3–6 there are disclosed different embodiments of the initiating element according to the invention, no time delay composition being used within the element. The embodiment shown in FIG. 3 is similar to that of FIG. 1, the only difference being that said delay composition is not present.

Figure 4:
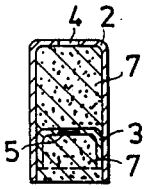

FIG. 4 differs from FIG. 3 in that the cap 3 is turned in the opposite direction as compared to that of FIG. 3, the walls of the open-ended shell 2 being extended beyond the cap 3 to form an open-ended tubular space between the cap 3 and the base charge 8. In last-mentioned tubular space there is also preferably used a charge of the secondary explosive 7 but having a lower density than that of the initiating charge 7 within the initiating element. Examples of useful densities in this respect are mentioned on p.9.

Figure 5:
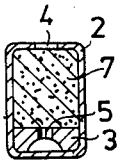

FIG. 5 shows an element in the form of a closed casing 2, the cap 3 having been replaced by a disk 3 within said casing 2. In this special case the aperture 5 is present in said disk 3.

Figure 6:
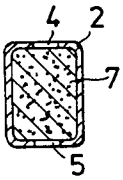

FIG. 6 shows a casing similar to that of FIG. 5 but without any internal cap or disk 3.

Figure 7:
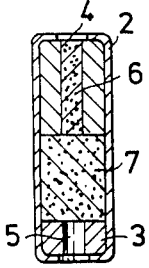
FIGS. 7–9 are cross-sectional views of other embodiments of the initiating element according to the invention with delay compositions incorporated.
Figure 8:
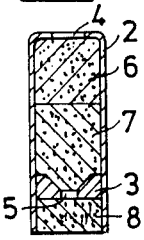

FIGS. 7–9 represent other embodiments of the initiating elements which elements also contain delay compositions.

Thus, the element shown in FIG. 7 can be compared to that of FIG. 5 but with a delay composition 6 present within the casing 2 at the end thereof adjacent the hole 4.

The element shown in FIG. 8 is similar to the elements of FIG. 3 and 4 and the only major difference relative to the elements of last-mentioned figures is that a delay composition 6 is present within the casing 2.

FIG. 9 represents an element with a special design of the shell 2 which combines the functions of a delay element and an initiating element.

Figure 10A:
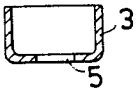
Figure 10B:
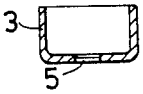
Figure 10C:
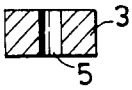

FIG. 10*a*–10*g* represent different embodiments of the cap or disk 3. FIG. 10*a* shows a cap 3 of the type that has already been shown in FIG. 1 with an aperture 5 through the wall of the cap 3. The cap shown in FIG.

10*b* differs from that of 10*a* through the fact that the bottom end of the cap 3 contains a recess 5 only. Thus, the cap 3 of FIG. 10*b* contains a thin wall adjaent the recess 5. FIG. 10*g* shows a cap without any aperture or recess at all.

Figure 10D:
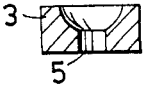
Figure 10E:
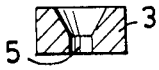
Figure 10F:
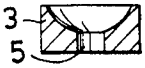
Figure 10G:
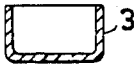

FIGS. 10*c*–10*f* show disks, for instance of a metal or a plastics material, with apertures 5 having different configurations and cross-sectional areas. The disk shown in FIG. 10*c* contains an aperture 5 the cross-section of which is circular. FIG. 10*d* shows a disk 3 with an aperture 5 containing a surface of revolution in the form of a hemisphere, while the disks according to the FIGS. 10*e* and 10*f* are similar to that of FIG. 10*d* but with a surface of revolution in the form of a cone and a paraboloid, respectively.

Although a preferable cross-sectional area of the recess is a circular one said area can also be rectangular, rhombic or any combinations of two or more of these sections.

FIG. 11*a* shows an instantaneous electric detonator with a shell 1*a* of paper. Thus, it should be noted that one of the advantages of the invention is that no particular requirements are to be set forth for the strength of the outer shell, which for instance means that the shell may be made of glass, aluminium, steel, any alloy, paper or plastic. The bottom end of the shell 1*a* is closed with sulphur or a plastic plug 13. The connection of the shell 1a with the electric fusehead 9 has been realized by a crimped linking of a metal sleeve 14 with the plastic plug 10.

FIG. 11*b* shows a delay electric detonator filled with an outer secondary explosive base charge 8 at the bottom of the outer shell 1*a*, followed by in turn an instantaneous initiating element 2 and a delay composition 6, between which there is a flame-conducting pyrotechnic composition 12 to accomplish a reliable ignition of the secondary explosive 7 within the initiating element 2.

FIG. 12*a* shows a non-electric detonator without any delay composition which detonator is ignited by a low energy cord or a NONEL tube 15. The shell 1*b* is of a plastics material. FIG. 12*b* is a metal-shelled non-electric delay detonator with an initiating element similar to that already shown in FIG. 9.

FIG. 13 shows a secondary explosive blasting cap fixed with a safety fuse 16, and where the flame-conducting pyrotechnic composition 12 is incorporated into the initiating element 2.

EXAMPLES

EXAMPLE 1

A bras-shelled detonator similar to that shown in FIG. 1 was manufactured. The bottom end of the detonator was filled with 650 mg of RDX as a base charge, and 300 mg of RDX and 250 mg of a pyrotechnic delay composition containing silica powder and red lead were filled into the steel-shelled initiating element. Upon initiation of the electric fusehead the base charge of the detonator detonated and caused a hole with a diameter of 12 mm in a 5 mm thick lead plate placed in contact with the bottom surface of the detonator.

EXAMPLE 2

Ten aluminimum-shelled detonators were manufactured with the same amounts of explosives as in Example 1 but with PETN instead of RDX in the initiating element. Their times from electric initiation to detonation upon initiation were 160 ms (milliseconds), 157 ms, 155 ms, 159 ms, 163 ms, 164 ms, 161 ms, 166 ms, 154 ms and 167 ms, respectively.

EXAMPLE 3

An aluminium-shelled detonator with the same volume of explosives as the one from Example 1 but with HMX instead of RDX in the initiating element was manufactured. Another difference relative to Example 1 was that a low energy tube was used instead of an electric fusehead. Into this detonator there was inserted an ANFO cartridge with a diameter of 32 mm with a charge of 200 mg, and then another similar cartridge was placed along the axial direction with a distance of 60 mm to the bottom end of the first cartridge. The ANFO formula was diesel 4, sawn chips 4/ammonium nitrate 92. Upon initiation of the NONEL tube the detonator and the cartridge detonated.

EXAMPLE 4

A steel-shelled detonator of the type shown in FIG. 13 was manufactured and filled with 600 mg of RDX at the bottom thereof, 200 mg of PETN in the initiating element and 80 mg of a flame-conducting pyrotechnic composition containing ferrosilicon and red lead. Upon the initiation of the detonator by a safety fuse the base charge detonated and a fuse with a length of 20 m, the end of which was lapped over the detonator, got a complete detonation too.

EXAMPLE 5

A paper-shelled detonator was manufactured and filled with 650 mg of RDX at the bottom end thereof and with 220 mg of HMX in the initiating element and without any pyrotechnic composition. The detonator was lapped at one end thereof with a fuse having a length of 1.2 m, the latter being filled with RDX in an amount of 13 g per meter. Upon initiation of the NONEL tube the base charge of the detonator detonated and the fuse was initiated too. The data recorded by an electric timer shows that the propagation time for the detonation with a distance of one meter between the two points of the fuse was 142.3 microseconds, which is equivalent to a detonation velocity of 7027.4 m/s.

EXAMPLE 6

Ten paper-shelled detonators as shown in FIG. 11*b* were manufactured, and the base charges and secondary explosive initiation charges thereof were the same as in Example 2, with the addition of 100 mg of a flame-conducting pyrotechnic composition 12 and a 300 mg delay charge consisting of a pyrotechnic material containing ferrosilicon and red lead. The delay times recorded upon initiation were 533 ms, 536 ms, 531 ms, 557 ms, 563 ms, 540 ms, 565 ms, 551 ms, 567 ms and 543 ms, respectively.

EXAMPLE 7

Detonators were prepared having an outer aluminium cap tube with a length of 62 mm, a wall thickness of 0.5 mm and an interior diameter of 6.5 mm. The tube contained a base charge of 450 mg of RDX compacted to a density of about 1.5 g/cm 3 and an initiating element similar to the design shown in FIG. 4 with a steel shell of 17 mm length, an outer diameter of 6.5 mm, a wall thickness of 0.6 mm and an upper hole of 2.5 mm diameter. The shell contained in its upper part a 200 mg initiating charge of about 5–15 μm size PETN powder compacted by a press force of 133 kg to a density of about 1.4 g/cm$^3$ and below this charge a 200 mg intermediate charge of the same PETN powder compacted by a pressure force of 70 kg to a density of only about 1.0 g/cm$^3$. Between the initiating charge and the intermediate charge a cup was inserted having an outer diameter of about 5.4 mm, a material thickness of about 0.5 mm, an aperture recess of 2.9 mm diameter and about 0.1 mm thickness. The entire cup being pressed as an integral structure from aluminium sheet. The detonators were ignited by an electrical fusehead above the initiating element hole. Detonation was obtained in all four tested samples.

EXAMPLE 8

Example 7 was repeated but using a cup with a wall thickness of 0.5 mm aluminium without an aperture or weakening. Two detonations out of two were obtained.

EXAMPLE 9

Example 7 was repeated but using a cup prepared from 0.1 mm brass sheet and having no aperture. Two detonations out of two tests were obtained.

EXAMPLE 10

Example 7 was repeated but using a cup prepared from 0.25 mm soft steel sheet and having no aperture. Two detonations out of two tests were obtained.

EXAMPLE 11

Example 7 was repeated but using a cup prepared from 1.1 mm aluminium sheet and having no aperture. Two detonations out of two were obtained.

EXAMPLE 12

Example 7 was repeated but using a cup prepared from 2.8 mm aluminium sheet and having no aperture. One detonation out of one tested was obtained.

EXAMPLE 13

Example 7 was repeated but without any cup or wall between initiating charge and intermediate charge. Six detonations out of six tested were obtained.

EXAMPLE 14

The initiating elements of example 7, comprising initiating charge, intermediate charge and an aluminium cup with an aperture recess in a 0.5 mm wall, were ignited separately from the exterior tube and base charge of the detonator. Four out of four initiating elements detonated.

We claim:

1. A non-primary explosive detonator comprising a hollow tube with a closed end having a chamber containing a base charge of a secondary explosive, an opposite open end adapted for the insertion of an igniting means, and an intermediate confinement adjacent said chamber and containing a pressed, initiating charge of a secondary explosive, the base charge being arranged to detonate by activation of the igniting means to ignite said initiating charge, wherein the confinement is thin-walled and contains said initiating charge, the confinement having an access permitting ignition of said initiating charge via the igniting means, and wherein an intermediate charge of a secondary explosive is arranged between the initiating charge and the base charge, said intermediate charge having a lower pressing density than said initiating charge.

2. A detonator according to claim 1, wherein the confinement wall at the end of the confinement has a thickness below 3 mm.

3. A detonator according to claim 2, wherein said access is a hole the cross-sectional areas of said hole being substantially less than the average cross-sectional area of the initiating charge, the ratio between said areas being from about 1:1.1 to 1:6.3.

4. A detonator according to claim 1, wherein the access is a hole.

5. A detonator according to claim 4 wherein a space is provided allowing escape of reaction product gases formed at the burning of the initiating charge.

6. A detonator according to claim 4, wherein a delay element is provided above the hole.

7. A detonator according to claim 6, wherein a space is provided allowing escape of reaction product gases formed at the burning of the secondary explosive initiating charge.

8. A detonator according to claim 4 wherein the confinement includes a shell which contains said hole and is open at its opposite end, and selectively having one of a separate cap and disk which fits into said open end and contains a thin wall, an aperture and a recess.

9. A detonator according to claim 1 wherein the confinement containing the initiating charge is an element separate from the hollow tube.

10. A detonator according to claim 9, wherein the element separate from the hollow tube comprises a shell which contains a hole and is open at its opposite end, and having a separate cap or disk which fits into said open end and contains one of a thin wall, an aperture and a recess.

11. A detonator according to claim 9, wherein the element separate from the hollow tube comprises a shell which contains said access, said access comprising a hole at one end of said confinement, said confinement being open at its opposite end and selectively having one of a separate cap and disk which fits into said open end and contains one of a thin wall, an aperture and a recess.

12. A detonator according to claim 9, wherein the element separate from the hollow tube copmrises a shell which contains a hole at a first end, and said shell containing one of a thin wall, an aperture and recess at its opposite end.

13. A detonator according to claim 1, wherein the ignition means is an electric heating wire buried in the confinement with conductors sealingly penetrating the confinement wall.

14. A detonator according to claim 1, said lower density of said intermediate charge being within the range of 0.8–1.4 g/cm$^3$.

15. A detonator according to claim 1, wherein the confinement is a thin-walled element of a material having a strength sufficient to alter deformation without bursting during the burning of the initiating charge.

16. A detonator according to claim 1, wherein the confinement contains also a delay composition.

17. A detonator according to claim 1, wherein the secondary explosive initiating charge comprises one of PETN and RDX.

18. A detonator according to claim 1, wherein the initiating charge has a particle size of less than 250 mesh ($\approx$ less than 0.06 mm), a specific surface of about 5000–7000 cm$^2$/g and a pressing density of about 1.2–1.6 g/cm$^3$.

19. A detonator according to claim 1, wherein the detonator contains a flame-conducting pyrotechnic composition in contact with said initiating charge.

20. A detonator according to claim 1, further including a delay composition adjacent said initiating charge, said initiating charge being ignited via said delay composition.

21. A detonator according to claim 1, wherein the intermediate charge is arranged in the confinement.

22. A detonator according to claim 1, wherein a thin wall is provided between said initiating charge and said intermediate charge.

23. A detonator according to claim 22, wherein the thin wall is separate from the rest of said confinement.

24. A detonator according to claim 22, wherein the thin wall is provided with one of an aperture and a recess.

25. A detonator according to claim 24, wherein the cross-sectional area of the aperture or recess is substantially less than the average cross-sectional area of the initiating charge, the ratio between said areas preferably being from about 1:2.5 to 1:4.

26. A detonator according to claim 25, wherein the confinement includes a shell which contains a hole and is open at its opposite end, and having a separate cap or disk which fits into said open end an contains one of a thin wall, an aperture and a recess.

27. A detonator according to claim 24 wherein the cross-sectional area of the aperture or recess is circular.

28. A detonator according to claim 27 wherein the aperture or recess includes a surface of revolution in the form of one of a hemisphere, a cone and a paraboloid.

29. A detonator according to claim 24, wherein the cross-sectional area of the aperture or recess is substantially less than the average cross-sectional area of the secondary explosive initiating charge, the ratio between said areas being from about 1:2.5 to 1:4.

30. An initiating element for use in a non-primary explosive detonator, comprising a thin walled confinement containing an initiating charge of a secondary explosive for exploding a base charge of a secondary explosive positioned outside of said confinement, an access in said confinement permitting ignition of said initiating charge via an ignition means, an intermediate charge of a secondary explosive arranged between said initiating charge and said base charge, said intermediate charge having a lower pressing density than said initiating charge, and means for conducting a shock wave from said confinement to said base charge.

31. An initiating element according to claim 30, wherein said shock wave conducting means comprises one of a thin walled member, an aperture, and a recess.

32. An initiating element according to claim 31, wherein said shock wave conducting means comprise one of said aperture and said recess, and wherein the cross-sectional area of said conducting means is less than an average cross-sectional area of said initiating charge.

33. An initiating element according to claim 32, wherein said conducting means is circular.

34. An initiating element according to claim 33 wherein the aperture or recess includes a surface of revolution in the form of one of a hemisphere, a cone and a paraboloid.

35. An initiating element according to claim 32, wherein the ratio of cross-sectional areas of said aperture or recess and said initiating charge is from about 1:2.5 to about 1:4.

36. An initiating element according to claim 30, wherein the element is a thin-walled element of a material having a strength sufficient to allow deformation without bursting during the burning of the secondary explosive initiating charge.

37. An initiating element according to claim 30, wherein the secondary explosive initiating charge comprises one of PETN and RDX.

38. An initiating element according to claim 30, wherein the secondary explosive initiating charge has a particle size of less than 250 mesh ($\approx$ less than 0.06 mm), a specific surface of about 5000–7000 $cm_2/g$ and a pressing density of about 1.2–1.6 $g/cm^3$.

39. An initiating element according to claim 30, wherein the element contains a flame-conducting pyrotechnic composition in contact with said initiating charge.

40. An initiating element according to claim 30, wherein said thin walled confinement comprises a shell containing said access and having an open end opposite said access.

41. An initiating element according to claim 40, wherein said thin walled confinement further includes a cap or disk fitted into said open end, said cap or disk including said means for conducting said shock wave.

42. An initiating element according to claim 44, wherein said shock wave conducting means comprises one of a thin walled member, an aperture, and a recess.

43. An initiating element according to claim 40, wherein said shell includes an extension beyond said initiating charge towards said base charge, and wherein said intermediate charge is positioned in said extension.

44. A non-primary explosive detonator, comprising:

(a) a hollow tube having a closed end and an open end;

(b) a base charge of a secondary explosive positioned in said tube adjacent said closed end;

(c) an initiating charge of a secondary explosive positioned in said tube adjacent said base charge and opposite said closed end;

(d) igniting means for igniting and burning said initiating charge; and (e) means for confining said initiating charge to thereby increase the rate of said burning to a level sufficient to create a shock wave for detonation of said base charge, said confining means confining said initiating charge at a point of ignition thereof;

wherein said detonator further includes an intermediate charge positioned between said confining means and said base charge.

45. A detonator according to claim 44, wherein said intermediate charge has a density of from about 0.8 to about 1.1 $g/cm^3$ and said initiating charge has a density of from about 1.2 to about 1.6 $g/cm^3$.

* * * * *